US009285736B1

(12) United States Patent
Kinuta

(10) Patent No.: US 9,285,736 B1
(45) Date of Patent: Mar. 15, 2016

(54) FIXING MEMBER, FIXING DEVICE, AND IMAGE FORMING APPARATUS

(71) Applicant: FUJI XEROX CO., LTD., Tokyo (JP)

(72) Inventor: Yasuhiko Kinuta, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/617,037

(22) Filed: Feb. 9, 2015

(30) Foreign Application Priority Data

Aug. 28, 2014 (JP) ..... 2014-174395

(51) Int. Cl.
*G03G 15/20* (2006.01)

(52) U.S. Cl.
CPC ..... *G03G 15/206* (2013.01)

(58) Field of Classification Search
CPC ..... G03G 15/2053; G03G 15/2057; G03G 15/206
See application file for complete search history.

(56) References Cited

U.S. PATENT DOCUMENTS

2012/0224897 A1* 9/2012 Qi et al. ..... 399/333
2012/0230742 A1 9/2012 Nakagawa et al.
2014/0348559 A1* 11/2014 Miyahara ..... 399/333

FOREIGN PATENT DOCUMENTS

JP 2012-198516 A 10/2012

OTHER PUBLICATIONS

JIS-B-0601 (1994), p. 2, "Relation between Arithmetic Average Roughness(Ra)and Conventional Parameters".*

* cited by examiner

*Primary Examiner* — David Gray
*Assistant Examiner* — Sevan A Aydin
(74) *Attorney, Agent, or Firm* — Oliff PLC

(57) ABSTRACT

Provided is a fixing member including an annular base material, and an innermost layer that is formed on an inner circumferential surface of the annular base material, the innermost layer including heat-resistant fibers.

11 Claims, 4 Drawing Sheets

FIXING MEMBER, FIXING DEVICE, AND IMAGE FORMING APPARATUS

CROSS-REFERENCE TO RELATED APPLICATIONS

This application is based on and claims priority under 35 USC 119 from Japanese Patent Application No. 2014-174395 filed Aug. 28, 2014.

BACKGROUND (i) Technical Field

The present invention relates to a fixing member, a fixing device, and an image forming apparatus.

(ii) Related Art

In an electrophotographic image forming apparatus (copier, facsimile, printer or the like), a fixing device fixes an unfixed toner image formed on a recording material to form an image.

SUMMARY

According to an aspect of the invention, there is provided a fixing member including:

an annular base material; and an innermost layer that is formed on an inner circumferential surface of the annular base material, the innermost layer including heat-resistant fibers.

BRIEF DESCRIPTION OF THE DRAWINGS

Exemplary embodiments of the present invention will be described in detail based on the following figures, wherein.

DETAILED DESCRIPTION

Figure 1:
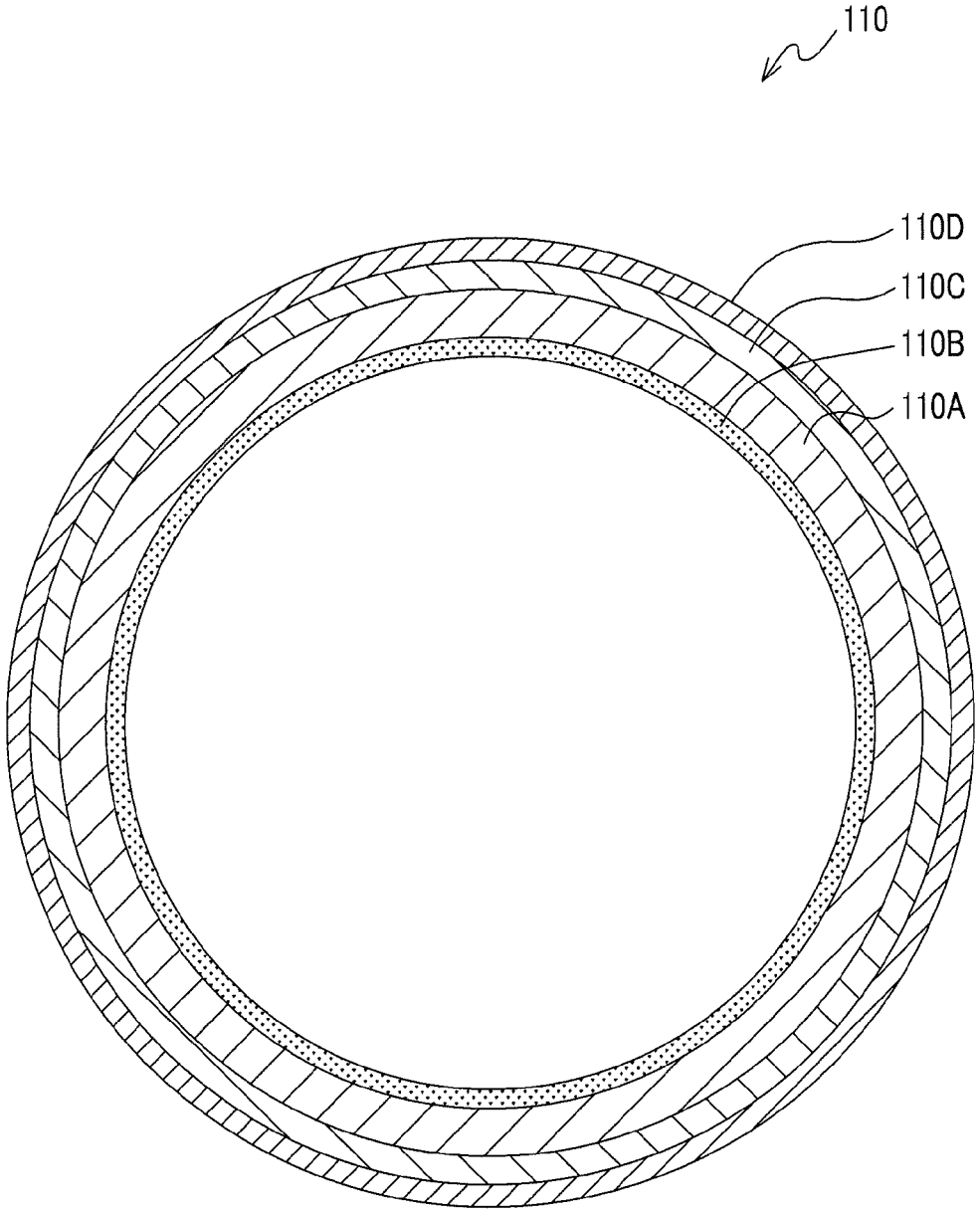
FIG. 1 is a schematic cross-sectional view showing an example of a fixing member according to the present exemplary embodiment.

Hereinafter, exemplary embodiments which are examples of the present invention will be described in detail.

Throughout the drawings, components that substantially have the same functions will be assigned the same reference numerals, and the redundant description thereof may be appropriately omitted.

Fixing Member

A fixing member according to the present exemplary embodiment will be described.

FIG. 1 is a schematic cross-sectional view showing an example of the fixing member according to the present exemplary embodiment.

As shown in FIG. 1, a fixing member 110 according to the present exemplary embodiment includes, for example, an annular base material 110A, and an innermost layer 110B that is provided on an inner circumferential surface of the annular base material 110A, and the innermost layer 110B has heat-resistant fibers. An elastic layer 110C and a surface layer 110D formed on the elastic layer 110C are formed on an outer circumferential surface of the annular base material 110A.

The fixing member 110 according to the present exemplary embodiment is not limited to the aforementioned layer structure. For example, a layer structure in which a metal layer or a protective layer thereof is interposed between the base material 110A and the elastic layer 110C may be used when necessary. The elastic layer 110C and the surface layer 110D are layers that are formed when necessary.

In the related art, as a type of the fixing device, a fixing type including, for example, a driving pressure roll, a fixing belt (an example of the fixing member), a pressure pad, and a heating source is used. In the fixing device of such a fixing type, since the fixing belt rotates while coming in contact with the pressure pad, a driving load occurs in the fixing belt. In order to reduce the driving load, for example, a lubricant is interposed between the pressure pad and an inner circumferential surface of the fixing belt. The inner circumferential surface of the fixing belt is roughened, and when the inner circumferential surface of the fixing belt is roughened, it is possible to improve retaining of the lubricant.

In recent years, there is an increasing demand for fixing devices, and, thus, fixing devices that may withstand a high-temperature condition have been examined. However, even though the fixing belt whose inner circumferential surface is roughened using a mold roughened through, for example, blast processing or cutting processing, is used, a usable life span thereof may be shortened. This is because even though the inner circumferential surface of the fixing belt is roughened as stated above, since viscosity of the lubricant is degraded and fluidity thereof is increased under the high temperature condition, it may be difficult to retain the lubricant on the inner circumferential surface.

Here, for example, if the fixing member according to the present exemplary embodiment including the innermost layer having the heat-resistant fibers is used as the fixing belt as an example of the fixing member, when the fixing member is used under a high-temperature condition (for example, 180° C. or more), a reduction in a retained amount of the lubricant retained in the inner circumferential surface of the innermost layer is suppressed. This reason is as follows.

The heat-resistant fibers exist in the innermost layer while the fibers are twisted together or the fibers overlap with one another.

When the heat-resistant fibers existing in such a state protrude from the inner circumferential surface of the innermost layer, an unevenness structure having a recessed concave-portion shape is formed on the inner circumferential surface of the innermost layer. Since the lubricant is retained up to the recessed concave-portion shape, even when the heat-resistant fibers are used under a high-temperature condition, the reduction in the retained amount of the lubricant may be suppressed. In the fixing member according to the present exemplary embodiment, since the reduction in the retained amount of the lubricant is suppressed, the usable life span is lengthened compared to the case where the fixing belt whose inner circumferential surface is roughened using the mold roughened through the blast processing or the cutting processing is used.

Accordingly, when the fixing member according to the present exemplary embodiment is used under a high-temperature condition (for example, 180° C. or more), the reduction in the retained amount of the lubricant retained in the inner circumferential surface of the innermost layer is suppressed.

Although it has been described as an example that the fixing device of the fixing type including the driving pressure roll, the fixing belt, the pressure pad and the heating source is used, the present invention is not limited to the fixing device of such a fixing type. If the present invention is applied to other types of fixing device, when the fixing member is used under a high-temperature condition, the reduction in the retained amount of the lubricant is also suppressed.

Hereinafter, components of the fixing member 110 according to the present exemplary embodiment will be described in detail.

The reference numerals will not be described.

Here, in the fixing member according to the present exemplary embodiment, the term "heat-resistant" refers to a characteristic in which the fixing member neither melts nor decomposes even though a temperature reaches a rising temperature of the fixing device (for example, a fixing temperature). That is, the fixing member has a property that may withstand the rising temperature of the fixing device.

Annular Base Material

Examples of the annular base material include a base material made from a metal such as nickel, aluminum or stainless steel; and a base material made from a resin such as polyimide, polyamide-imide, polyphenylene sulfide, polyether ether ketone or polybenzimidazole. When the annular base material is made from a resin, in order to control a characteristic such as thermal conductivity, the annular base material may include various fillers such as carbon black.

Among these base materials, since the innermost layer having the heat-resistant fibers is formed on the inner circumferential surface, resin base materials are preferably used as the base material. Among the resin base materials, polyimide base material is more preferably used in terms of heat resistance, mechanical strength, and manufacturability.

For example, a thickness of the base material is preferably from 20 μm to 200 μm, more preferably from 30 μm to 150 μm, and even more preferably from 40 μm to 130 μm.

Innermost Layer

Since the innermost layer includes the heat-resistant fibers, the unevenness structure having the recessed concave-portion shape is formed on the inner circumferential surface. Since the unevenness structure is formed, even when the fixing member is used under a high-temperature condition, the reduction in the retained amount of the lubricant is suppressed. That is, the innermost layer functions as a layer that retains the lubricant.

The innermost layer may include, for example, a resin in addition to the heat-resistant fibers. In order to hold the heat-resistant fibers together and to hold the innermost layer by the base material, the innermost layer preferably includes a resin.

Heat-Resistant Fiber

The term "fiber" is a material having an elongated shape such as a thread shape or a string shape.

That is, the term "heat-resistant fiber" refers to a material having an elongated shape such as a thread shape or a string shape which neither melts nor decomposes even when the temperature reaches the rising temperature of the fixing device.

The heat-resistant fibers are not particularly limited as long as the fibers have heat resistance. The heat-resistant fibers may be natural organic fibers such as from plants or artificial organic fibers such as a resin, or may be inorganic fibers. Specifically, examples of the heat-resistant fibers include organic fibers such as polyimide fibers, polyamide-imide fibers, polyphenylene sulfide fibers, polyether ether ketone fibers or polybenzimidazole fibers; and inorganic fibers such as glass fibers, ceramic fibers or carbon fibers.

As the heat-resistant fibers, only one kind of fiber may be used, or two or more kinds of fiber may be used. For example, as the organic fibers, a single fiber using only one kind of a resin may be used, or mixed fibers using two or more kinds of resins may be used.

In order to suppress abrasions or scratches to a member coming in contact with the innermost layer, among these fibers, the organic fibers are preferably used. Among these organic fibers, polyimide fibers are more preferably used in terms of heat resistance, mechanical strength and manufacturability.

In the heat-resistant fibers, in order to more easily suppress the reduction in the retained amount of the lubricant, a diameter of the heat-resistant fibers is preferably equal to or greater than the thickness of the innermost layer. With such a configuration, the heat-resistant fibers that are twisted together or overlap with one another protrude from the inner circumferential surface with ease, and an unevenness structure having the recessed concave-portion shape is more easily formed. Retentivity of the lubricant is further improved.

In order to more easily suppress the reduction in the retained amount of the lubricant, in a surface profile of the inner circumferential surface of the innermost layer, an arithmetic average roughness (Ra) of the inner circumferential surface is preferably from 0.05 μm to 0.8 μm, and more preferably from 0.1 μm to 0.5 μm.

The arithmetic average roughness (Ra) is a value obtained by measuring roughnesses of ten portions under conditions where a measurement length is 4 mm, a cut-off wavelength is 0.8 mm, a measurement magnification is 1,000× magnification and a measurement speed is 0.3 mm/sec by using a surface roughness measuring instrument (SURFCOM 1500DX (manufactured by TOKYO SEIMITSU CO., LTD.)), and calculating an average value of the measured roughnesses.

In order to more easily form the unevenness structure having the recessed concave-portion shape in the inner circumferential surface by twisting the fibers together or overlapping the fibers with one another, the diameter of the heat-resistant fibers is preferably from 0.5 μm to 20 μm, more preferably from 1 μm to 10 μm, and even more preferably from 3 μm to 10 μm.

In order to more easily form the unevenness structure having the recessed concave-portion shape in the inner circumferential surface by twisting the fibers together or overlapping the fibers with one another, a length of the heat-resistant fibers is preferably from 1 mm to 100 mm, more preferably from 3 mm to 30 mm, and even more preferably from 3 mm to 10 mm.

In order to more easily form the unevenness structure having the recessed concave-portion shape in the inner circumferential surface by twisting the fibers together or overlapping the fibers with one another, it is preferable that heat-resistant fibers having a diameter ranging from 0.5 μm to 20 μm and a length ranging from 1 mm to 100 mm is used. It is more preferable that heat-resistant fibers having a diameter ranging from 1 μm to 10 μm and a length ranging from 3 mm to 30 mm is used. It is even more preferable that heat-resistant fibers having a diameter ranging from 3 μm to 10 μm and a length ranging from 3 mm to 10 mm is used.

The diameter and the length of the heat-resistant fibers are measured as follows.

The diameter and the length of the heat-resistant fibers are obtained by cutting the innermost layer into slices, observing thirty heat-resistant fibers using a scanning electron microscope (SEM), measuring diameters and lengths of the respective heat-resistant fibers through image analysis, and calculating average values of the measured diameters and lengths.

In order to more easily suppress the reduction in the retained amount of the lubricant, the thickness of the innermost layer is preferably from 1 μm to 50 μm, more preferably from 5 μm to 20 μm, and even more preferably from 5 μm to 10 μm.

The thickness of the innermost layer is measured as follows.

The thickness of the innermost layer is a value obtained by cutting the innermost layer into slices, observing the slices using a SEM, measuring thicknesses of the cut slices through image analysis, and calculating an average value of the measured thicknesses. Specifically, the thickness of the innermost layer is a value by measuring distances from a surface on which the base material of the innermost layer is formed to top portions of ten convex portions of the inner circumferential surface of the innermost layer and a distance from the surface on which the base material of the innermost layer is formed to top portions of ten concave portions of the inner circumferential surface, and then calculating an average value of the measured distances.

In order to more easily suppress the reduction in the retained amount of the lubricant, a content of the heat-resistant fibers included in the innermost layer is preferably from 20% by weight to 80% by weight with respect to the entire innermost layer, and more preferably from 30% by weight to 70% by weight.

Resin

The innermost layer includes, for example, a resin in addition to the heat-resistant fibers. This resin is a component that holds the heat-resistant fibers together or holds the innermost layer by the base material. Preferably, the resin has heat resistance. Specifically, examples of the resin include a polyimide resin, a polyamide-imide resin, a polyphenylene sulfide resin, a polyether ether ketone resin, a polybenzimidazole resin, and a polybenzoxazole resin.

For example, in order to suppress a reduction in the retentivity between the heat-resistant fibers or between the innermost layer and the base material, the same kind of resin as that used for the heat-resistant fibers or the base material is preferably used as this resin. For example, when the heat-resistant fibers are polyimide fibers and the base material is a base material made from a polyimide resin, polyimide resin is preferably used as this resin.

Elastic Layer

The fixing member according to the present exemplary embodiment may have the elastic layer depending on the purpose for use. The elastic layer is a layer that is formed on the outer circumferential surface of the annular base material. Preferably, the elastic layer includes a heat-resistant elastic material.

Examples of the heat-resistant elastic material include a silicone rubber and a fluororubber.

Examples of the silicone rubber include an RTV silicone rubber, an HTV silicone rubber and a liquid silicone rubber, and specifically include a polydimethyl silicone rubber (MQ), a methylvinyl silicone rubber (VMQ), a methylphenyl silicone rubber (PMQ), and a fluorosilicone rubber (FVMQ).

Examples of the fluororubber include a vinylidene fluoride-based rubber, a tetrafluoroethylene/propylene-based rubber, a tetrafluoroethylene/perfluoromethyl vinyl ether rubber, a phosphazene-based rubber and a fluoropolyether rubber.

Various additives may be added to the elastic layer. Examples of the additive include a softener (paraffin-based softener and the like), a processing aid (stearic acid and the like), antioxidants (amine-based antioxidants and the like), vulcanizing agents (sulfur, metallic oxides, peroxides and the like), and functional fillers (alumina and the like).

For example, a thickness of the elastic layer is preferably from 30 μm to 600 μm, and more preferably from 100 μm to 500 μm.

Surface Layer

The fixing member according to the present exemplary embodiment may have the surface layer depending on the purpose for use, and preferably includes the surface layer. The surface layer is a layer that is formed on the outer circumferential surface of the annular base material. The surface layer includes, for example, a heat-resistant releasing material.

Examples of the heat-resistant releasing material include a fluororubber, a fluororesin, a silicone resin and a polyimide resin.

Among these materials, a fluororesin may be used as the heat-resistant releasing material. Specifically, examples of the fluororesin include tetrafluoroethylene/perfluoro (alkyl vinyl ether) copolymer (PFA), polytetrafluoroethylene (PTFE), tetrafluoroethylene/hexafluoropropylene copolymer (FEP), polyethylene/tetrafluoroethylene copolymer (ETFE), polyvinylidene fluoride (PVDF), polychloro-trifluoroethylene (PCTFE), and vinyl fluoride (PVF).

For example, a thickness of the surface layer is preferably from 5 μm to 50 μm, and more preferably from 10 μm to 40 μm.

Purpose of Fixing Member

For example, the fixing member according to the present exemplary embodiment is applied to any one of a heating belt and a pressure belt, as an endless belt. As the heating belt, any one of a heating belt that performs heating by an electromagnetic induction method and a heating belt that performs heating by using an external heating source may be used.

However, when the fixing member according to the present exemplary embodiment is applied to the heating belt that performs heating by the electromagnetic induction method, a metal layer (heat generating layer) that generates heat through electromagnetic induction may be formed between the base material and the elastic layer.

Fixing Device

The fixing device according to the present exemplary embodiment has various configurations, and includes, for example, a first rotating member, and a second rotating member disposed to come in contact with an outer surface of the first rotating member. The fixing member according to the present exemplary embodiment is applied to at least one of the first rotating member and the second rotating member.

Hereinafter, a fixing device that includes a heating roll and a pressure belt will be described as the first exemplary embodiment. A fixing device that includes a heating belt and a pressure roll will be described as the second exemplary embodiment. In the first and second exemplary embodiments, the fixing member according to the present exemplary embodiment may be applied to any one of the pressure belt and the heating belt.

The fixing device according to the present exemplary embodiment is not limited to the first and second exemplary embodiments. For example, the fixing device according to the present exemplary embodiment may be a fixing device using an electromagnetic-induction heating method.

[First Exemplary Embodiment of Fixing Device]

Figure 2:
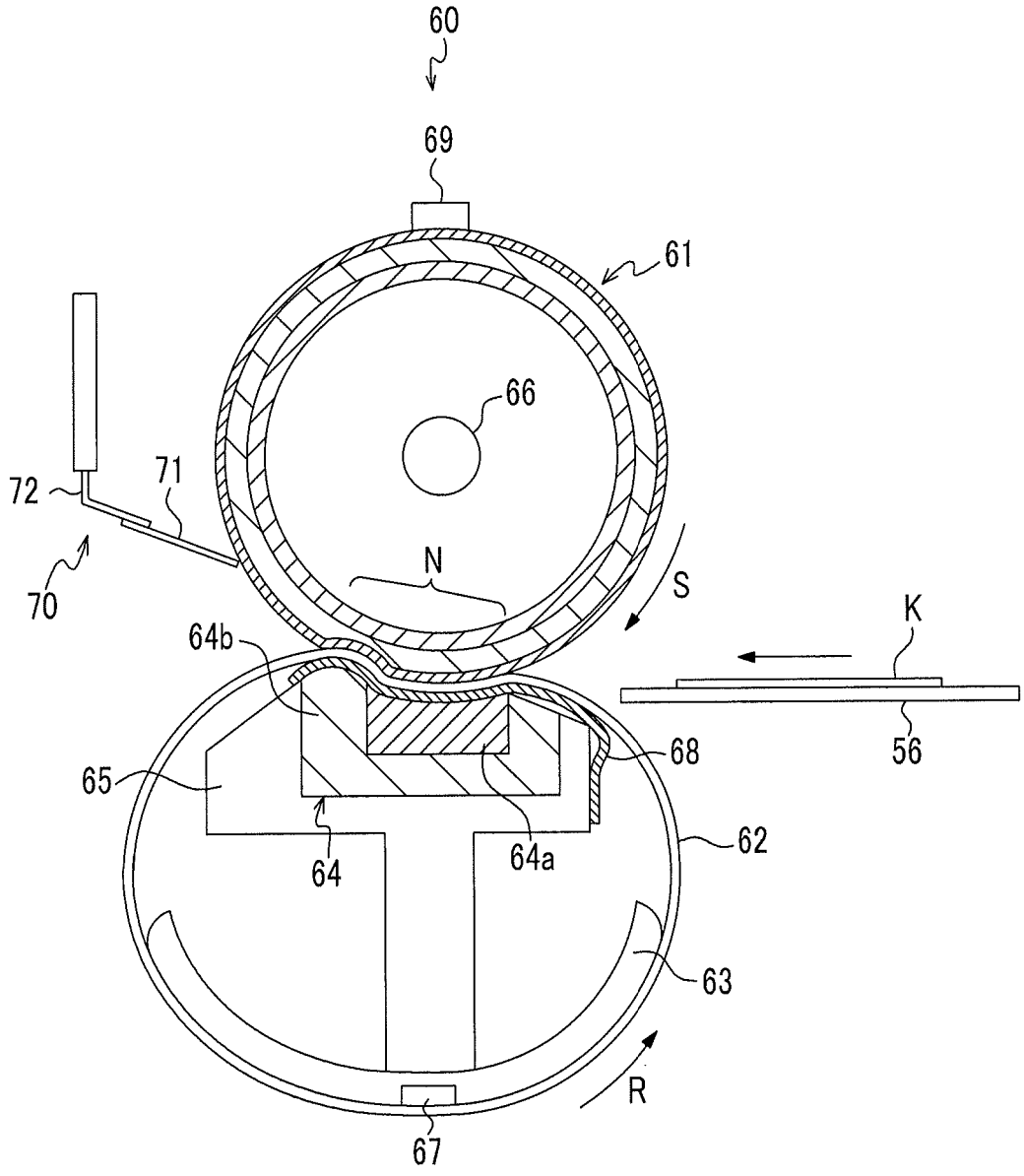
FIG. 2 is a schematic configuration diagram showing an example of a fixing device according to a first exemplary embodiment.

The fixing device according to the first exemplary embodiment will be described. FIG. 2 is a schematic diagram showing an example of the fixing device according to the first exemplary embodiment.

In the fixing device according to the first exemplary embodiment, the fixing member according to the present exemplary embodiment is used as the pressure belt (an example of the fixing member).

As shown in FIG. 2, a fixing device 60 according to the first exemplary embodiment includes, for example, a heating roll 61 (an example of the first rotating member) that is driven to be rotated, a pressure belt 62 (an example of the second rotating member), and a pressing pad 64 (an example of a pressing member) that presses the heating roll 61 through the pressure belt 62.

For example, the pressing pad 64 may be configured such that the pressure belt 62 and the heating roll 61 are relatively pressurized. Accordingly, the pressure belt 62 may be pressurized by the heating roll 61, or the heating roll 61 may be pressurized by the pressure belt 62.

A halogen lamp 66 (an example of a heating unit) is disposed within the heating roll 61. The heating unit is not limited to the halogen lamp, and other heat generating members that generate heat may be used.

For example, a temperature sensing element 69 is disposed to come in contact with a surface of the heating roll 61. Lighting of the halogen lamp 66 is controlled based on a measured temperature value by the temperature sensing element 69, and is controlled such that a surface temperature of the heating roll 61 is set to a target set temperature.

For example, the pressure belt 62 is rotatably supported by the pressing pad 64 and a belt traveling guide 63 that are arranged inside the pressure belt. The pressure belt is disposed to be pressed against the heating roll 61 by the pressing pad 64 in a nip region N (nip portion).

For example, the pressing pad 64 is disposed inside the pressure belt 62 while being pressurized by the heating roll 61 through the pressure belt 62, and the nip region N is formed between the heating roll 61 and the pressing pad.

For example, in the pressing pad 64, a front nip member 64*a* for ensuring the nip region N having a wide width is disposed on an inlet side of the nip region N, and a peeling nip member 64*b* for causing deformation of the heating roll 61 is disposed on an outlet side of the nip region N.

In order to reduce sliding friction between the pressing pad 64 and an inner circumferential surface of the pressure belt 62, a sheet-like sliding member 68 is disposed on, for example, surfaces of the front nip member 64*a* and the peeling nip member 64*b* which come in contact with the pressure belt 62. The pressing pad 64 and the sliding member 68 are held by a metal holding member 65.

For example, the sliding member 68 is provided such that a sliding surface thereof comes in contact with the inner circumferential surface of the pressure belt 62, and is involved in retaining and supplying a lubricant existing between the pressure belt 62 and the sliding member.

For example, the belt traveling guide 63 is attached to the holding member 65 to rotate the pressure belt 62.

The heating roll 61 is rotated by, for example, a non-illustrated driving motor in an arrow S direction, and the pressure belt 62 is rotated in an arrow R direction opposite to the rotation direction of the heating roll 61 by the rotation of the heating roll. That is, for example, the heating roll 61 is rotated in a clockwise direction in FIG. 2, whereas the pressure belt 62 is rotated in a counterclockwise direction.

Sheet K (an example of a recording medium) having an unfixed toner image is guided by, for example, a fixing inlet guide 56, and is transported to the nip region N. When the sheet K passes through the nip region N, the toner image on the sheet K is fixed by a pressure and heat acting on the nip region N.

For example, in the fixing device 60 according to the first exemplary embodiment, the wide nip region N is ensured by the front nip member 64*a* having a concave shape following an outer circumferential surface of the heating roll 61, compared to a configuration in which the front nip member 64*a* is not provided.

For example, in the fixing device 60 according to the first exemplary embodiment, the deformation of the heating roll 61 is locally exacerbated in the outlet region of the nip region N by disposing the peeling nip member 64*b* to protrude toward the outer circumferential surface of the heating roll 61.

For example, when the peeling nip member 64*b* is disposed as described above, since the sheet K after fixing passes through the locally exacerbated deformation portion at the time of passing through a peeling nip region, the sheet K is easily peeled off from the heating roll 61.

As a peeling assist unit, a peeling member 70 is disposed on, for example, a downstream side of the nip region N of the heating roll 61. For example, the peeling member 70 is held by a holding member 72 in a direction (counter direction) in which a separation pawl 71 faces the rotation direction of the heating roll 61 while approaching the heating roll 61.

[Second Exemplary Embodiment of Fixing Device]

Figure 3:
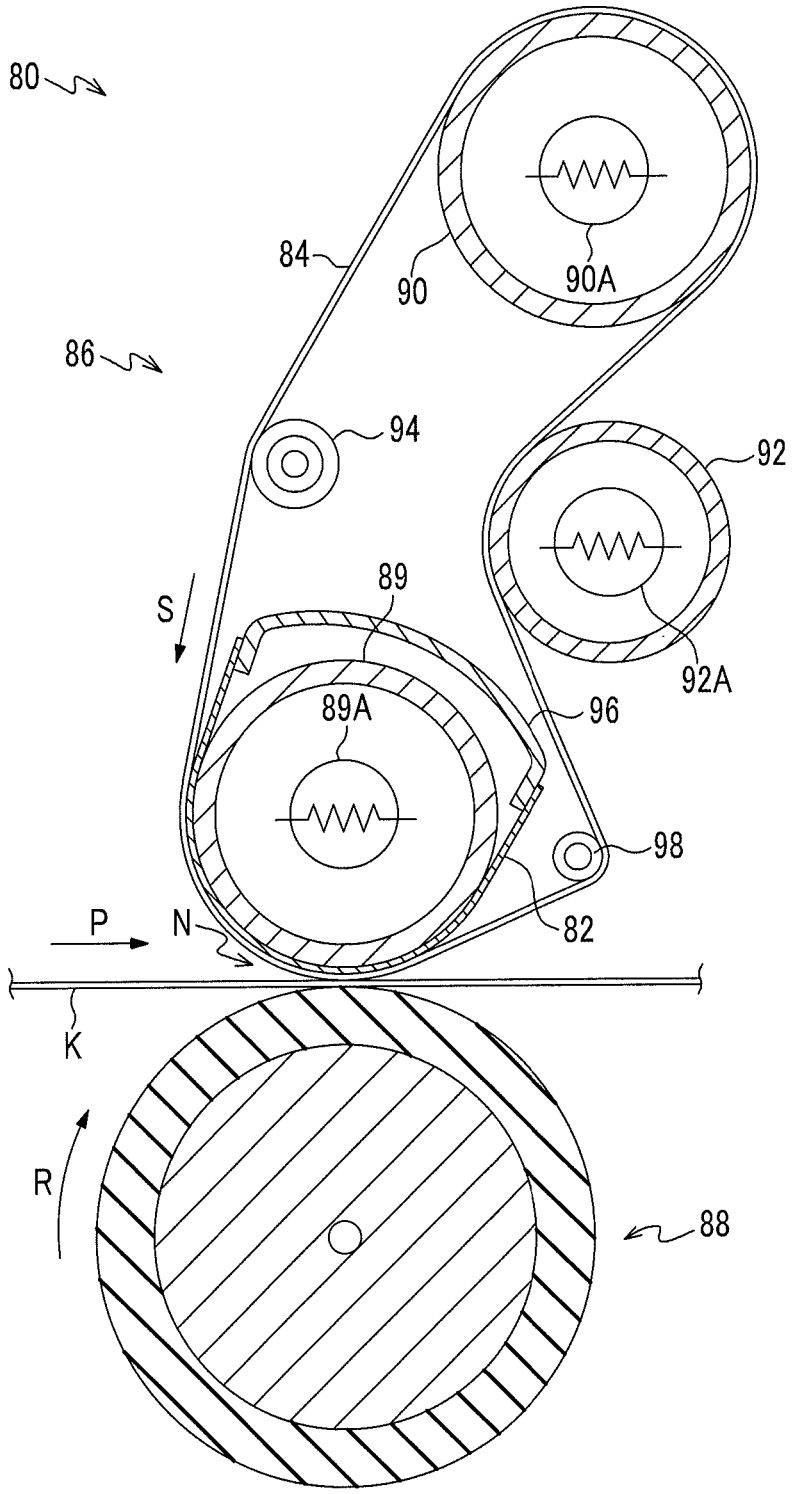
FIG. 3 is a schematic configuration diagram showing an example of a fixing device according to a second exemplary embodiment.

A fixing device according to the second exemplary embodiment will be described. FIG. 3 is a schematic diagram showing an example of the fixing device according to the second exemplary embodiment. In the fixing device according to the second exemplary embodiment, the fixing member according to the present exemplary embodiment is applied as the heating belt (an example of the fixing member).

As shown in FIG. 3, a fixing device 80 according to the second exemplary embodiment includes, for example, a fixing belt module 86 including a heating belt 84 (an example of the first rotating member), and a pressure roll 88 (an example of the second rotating member) disposed to be pressed by the heating belt 84 (fixing belt module 86). For example, a nip region N (nip portion) where the heating belt 84 (fixing belt module 86) and the pressure roll 88 come in contact with each other is formed. In the nip region N, the sheet K (an example of the recording medium) is pressurized and heated, and, thus, the toner image is fixed.

The fixing belt module 86 includes, for example, the endless heating belt 84; a heating press roll 89 which is disposed close to the pressure roll 88, around which the heating belt 84 is wound, which is driven to be rotated by rotational force of a motor (not shown), and which presses the heating belt 84 toward the pressure roll 88 from an inner circumferential surface thereof; and a support roll 90 that is disposed in a position different from that of the heating press roll 89 to support the heating belt 84 from the inside.

The fixing belt module 86 includes, for example, a support roll 92 that is disposed outside the heating belt 84 to define a circling path thereof, a posture correcting roll 94 that corrects a posture of the heating belt 84 from the heating press roll 89 to the support roll 90, and a support roll 98 that exerts tension to the heating belt 84 from an inner circumferential surface on a downstream side of the nip region N which is a region where the heating belt 84 (fixing belt module 86) and the pressure roll 88 come in contact with each other.

For example, the fixing belt module 86 is provided such that a sheet-like sliding member 82 is interposed between the heating belt 84 and the heating press roll 89.

For example, the sliding member 82 is provided such that a sliding surface thereof comes in contact with the inner circumferential surface of the heating belt 84, and is involved in retaining and supplying a lubricant existing between the heating belt 84 and the sliding member.

Here, for example, the sliding member 82 is provided while both ends thereof are supported by a support member 96.

For example, a halogen heater 89A (an example of the heating unit) is provided inside the heating press roll 89.

The support roll 90 is, for example, a cylindrical roll made from aluminum, and a halogen heater 90A (an example of the heating unit) is provided inside the support roll to heat the heating belt 84 from the inner circumferential surface.

For example, spring members (not shown) that outwardly press the heating belt 84 are disposed at both ends of the support roll 90.

The support roll 92 is, for example, a cylindrical roll made from aluminum, and a releasing layer which includes a fluororesin having a thickness of 20 μm is formed on a surface of the support roll 92.

The releasing layer of the support roll 92 is formed, for example, to prevent toner or sheet dust from an outer circumferential surface of the heating belt 84 from being deposited on the support roll 92.

For example, a halogen heater 92A (an example of a heating source) is provided inside the support roll 92 to heat the heating belt 84 from the outer circumferential surface.

That is, the heating belt 84 is heated by the heating press roll 89, the support roll 90 and the support roll 92.

The posture correcting roll 94 is, for example, a columnar roll made from aluminum, and an end position measuring mechanism (not shown) that measures a position of an end of the heating belt 84 is disposed near the posture correcting roll 94.

For example, an axis displacing mechanism (not shown) that displaces a contact position in an axis direction of the heating belt 84 based on a measurement result of the end position measuring mechanism is disposed at the posture correcting roll 94 to control belt meandering of the heating belt 84.

For example, the pressure roll 88 is rotatably supported, and is provided to be pressed by an urging unit such as a non-illustrated spring in a position where the heating belt 84 is wound around the heating press roll 89. Accordingly, the heating belt 84 (heating press roll 89) of the fixing belt module 86 is moved while rotating in an arrow S direction, and, thus, the pressure roll 88 is moved while rotating in an arrow R direction along with the heating belt 84 (heating press roll 89).

When the sheet K having the unfixed toner image (not shown) is transported in an arrow P direction and is guided to the nip region N of the fixing device 80, the unfixed toner image on the sheet is fixed by a pressure and heat acting on the nip region N.

Although it has been described the fixing device 80 according to the second exemplary embodiment that the halogen heater (halogen lamp) is applied to as an example of the heating source, the present invention is not limited thereto. As the heating source, a radiative lamp heating element (heating element that generates radiant rays (infrared rays or the like)), and a resistance heating element (heating element that generates Joule heat by allowing a current to flow in a resistor: for example, a heating element obtained by forming a film having a thick film resistor on a ceramic substrate and sintering the film) may be used instead of the halogen heater.

Image Forming Apparatus

Next, an image forming apparatus according to the present exemplary embodiment will be described.

The image forming apparatus according to the present exemplary embodiment includes an image holding member, a charging unit that charges a surface of the image holding member, a latent image forming unit that forms a latent image on the charged surface of the image holding member, a developing unit that develops the latent image by the toner to form a toner image, a transfer unit that transfers the toner image onto a recording medium, and a fixing unit that fixes the toner image on the recording medium. The fixing device according to the present exemplary embodiment is applied as the fixing unit.

Hereinafter, the image forming apparatus according to the present exemplary embodiment will be described with reference to the drawings.

Figure 4:
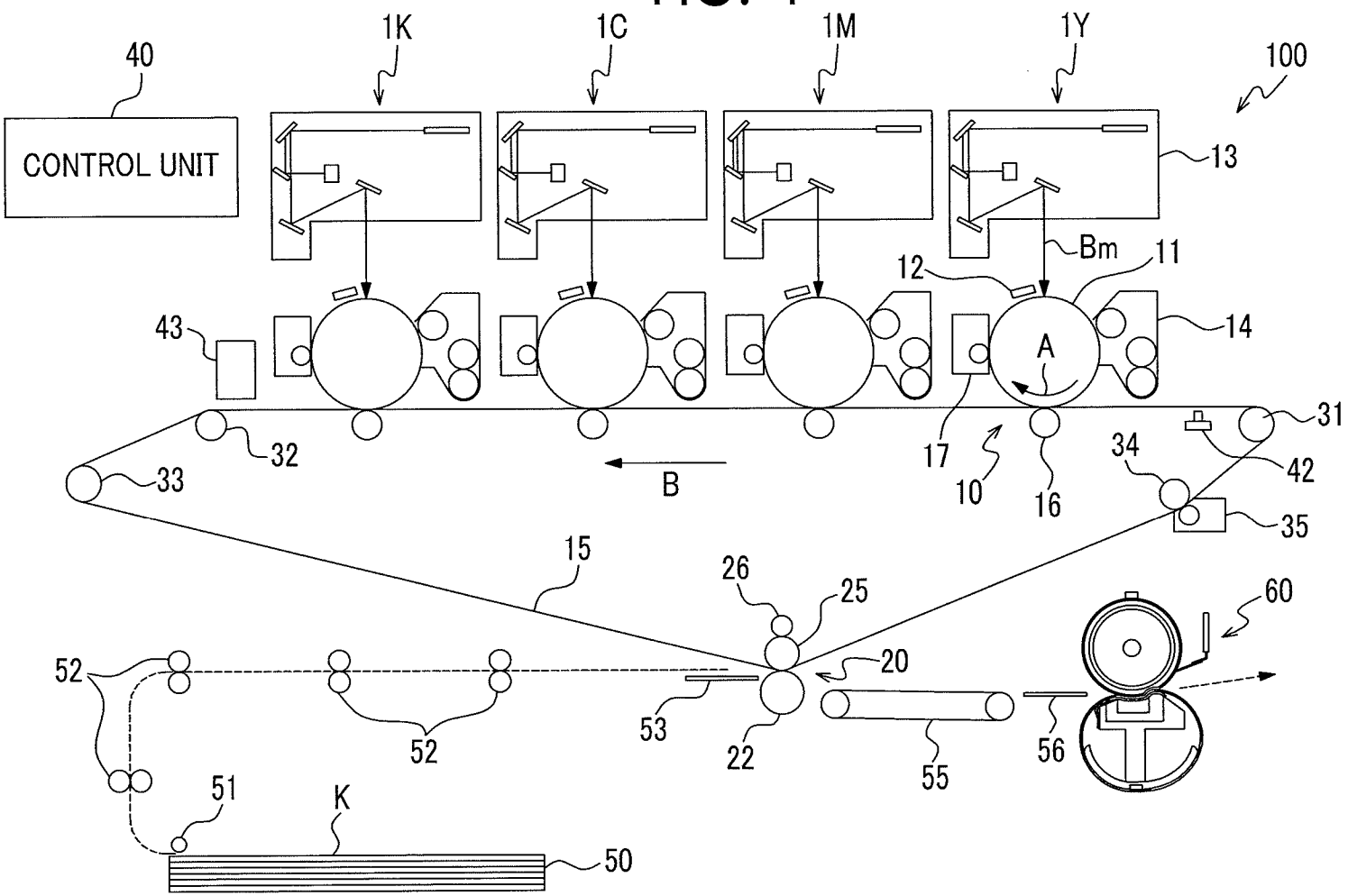
FIG. 4 is a schematic configuration diagram showing an example of an image forming apparatus according to the present exemplary embodiment.

FIG. 4 is a schematic configuration diagram showing a configuration of the image forming apparatus according to the present exemplary embodiment.

As shown in FIG. 4, an image forming apparatus 100 according to the present exemplary embodiment is, for example, an image forming apparatus of an intermediate transfer type that is generally called a tandem type, and includes plural image forming units 1Y, 1M, 1C and 1K that form toner images of the respective color components by an electrophotographic method, a primary transfer unit 10 that sequentially transfers (primarily transfers) the toner images of the respective color components formed by the image forming units 1Y, 1M, 1C and 1K onto an intermediate transfer belt 15, a secondary transfer unit 20 that collectively transfers (secondarily transfers) superposed toner images transferred onto the intermediate transfer belt 15 onto the sheet K as the recording medium, and the fixing device 60 that fixes the secondarily transferred images on the sheet K. The image forming apparatus 100 further includes a control unit 40 that controls operations of the respective units (the respective components).

The fixing device 60 is the fixing device 60 according to the first exemplary embodiment described above. The image forming apparatus 100 may include the fixing device 80 according to the second exemplary embodiment described above.

The image forming units 1Y, 1M, 1C and 1K of the image forming apparatus 100 are examples of the image holding members that hold the toner images formed on the surfaces, and respectively include photoreceptors 11 rotating in an arrow A direction.

A charging device 12 that charges the photoreceptor 11 is provided near the photoreceptor 11, as an example of the charging unit, and a laser exposure device 13 (an exposure beam in the drawing is denoted by reference numeral Bm) that writes an electrostatic latent image on the photoreceptor 11 is provided as an example of the latent image forming unit.

A developing device 14 that stores a toner of each color component to visualize the electrostatic latent image on the photoreceptor 11 by the toner is provided near the photoreceptor 11, as an example of the developing unit. A primary transfer roll 16 that transfers the toner image of each color component formed on the photoreceptor 11 onto the intermediate transfer belt 15 by the primary transfer unit 10 is provided.

A photoreceptor cleaner 17 that removes toner remaining on the photoreceptor 11 is provided near the photoreceptor 11, and electrophotographic devices such as the charging device 12, the laser exposure device 13, the developing device 14, the primary transfer roll 16 and the photoreceptor cleaner 17 are sequentially arranged in a rotation direction of the photoreceptor 11. These image forming units 1Y, 1M, 1C and 1K are arranged in a substantially straight line in order of yellow (Y), magenta (M), cyan (C) and black (K) from an upstream side of the intermediate transfer belt 15.

The intermediate transfer belt 15 as an intermediate transfer member is a film-like pressure belt that includes a resin such as polyimide or polyamide as a base layer and includes an appropriate amount of anti-static materials such as carbon black. The intermediate transfer belt is formed such that a volume resistivity thereof is from $10^6$ Ωcm to $10^{14}$ Ωcm and a thickness thereof is, for example, approximately 0.1 mm.

The intermediate transfer belt 15 is driven to be circulated (rotated) at a target speed in a B direction shown in FIG. 4 by various rolls. As the various rolls, there are a driving roll 31 that is driven by a motor (not shown) having an excellent constant speed characteristic to rotate the intermediate transfer belt 15, a support roll 32 that supports the intermediate transfer belt 15 extending in a substantially straight line in an arrangement direction of the respective photoreceptors 11, a tension exerting roll 33 that exerts tension to the intermediate transfer belt 15 and functions as a correction roll which prevents belt meandering of the intermediate transfer belt 15, a rear roll 25 that is provided at the secondary transfer unit 20, and a cleaning rear roll 34 that is provided by a cleaning unit that scrapes the toner remaining on the intermediate transfer belt 15.

The primary transfer unit 10 includes the primary transfer rolls 16 that are disposed to face the photoreceptors 11 with the intermediate transfer belt 15 interposed therebetween. The primary transfer roll 16 includes a core member, and a sponge layer as an elastic layer that is attached near the core member. The core member is a columnar bar made from a metal such as iron or SUS. The sponge layer is made from a rubber blend of NBR, SBR and EPDM to which a conductive agent such as carbon black is added, and is a sponge-like cylindrical roll having a volume resistivity ranging from $10^{7.5}$ Ωcm to $10^{8.5}$ Ωcm.

The primary transfer roll 16 is disposed to come in press contact with the photoreceptor 11 with the intermediate transfer belt 15 interposed therebetween. A voltage (primary transfer bias) having an opposite polarity to a charge polarity (assumed to be a minus polarity, the same hereinafter) of the toner is applied to the primary transfer roll 16. Accordingly, the toner images on the respective photoreceptors 11 are electrostatically attracted in sequence onto the intermediate transfer belt 15, and, thus, superposed toner images are formed on the intermediate transfer belt 15.

The secondary transfer unit 20 includes the rear roll 25, and a secondary transfer roll 22 that is disposed on a toner image holding surface of the intermediate transfer belt 15.

The rear roll 25 is a tube whose surface is made from a rubber blend of EPDM and NBR into which carbon is dispersed, and an inner portion thereof is made from EPDM rubber. The rear roll is formed such that a surface resistivity is from $10^7$Ω/□ to $10^1$Ω/□, and hardness thereof is set to, for example, 70° (ASKER C: manufactured by KOBUNSHI KEIKI CO., LTD., the same hereinafter). The rear roll 25 is disposed on a rear surface of the intermediate transfer belt 15 to form a facing electrode of the secondary transfer roll 22, and a metal power supply roll 26 to which a secondary transfer bias is stably applied is disposed to come in contact with the rear roll.

Meanwhile, the secondary transfer roll 22 includes a core member, and a sponge layer as an elastic layer that is attached near the core member. The core member is a columnar bar made from a metal such as iron or SUS. The sponge layer is made from a rubber blend of NBR, SBR and EPDM to which a conductive agent such as carbon black is added, and is a sponge-like cylindrical roll having a volume resistivity ranging from $10^{7.5}$ Ωcm to $10^{8.5}$ Ωcm.

The secondary transfer roll 22 is disposed to come in press-contact with the rear roll 25 with the intermediate transfer belt 15 interposed therebetween. The secondary transfer roll 22 is grounded, and, thus, a secondary transfer bias is formed between the rear roll 25 and the secondary transfer roll. Accordingly, the toner images are secondarily transferred onto the sheet K transported to the secondary transfer unit 20.

An intermediate-transfer-belt cleaner 35 that removes the toner or sheet dust remaining on the intermediate transfer belt 15 after the secondary transfer to clean the surface of the intermediate transfer belt 15 is disposed on a downstream side of the intermediate transfer belt 15 with respect to the secondary transfer unit 20 such that the intermediate-transfer-belt cleaner comes in contact with or is separated from the intermediate transfer belt.

The intermediate transfer belt 15, the primary transfer unit 10 (primary transfer roll 16) and the secondary transfer unit 20 (secondary transfer roll 22) correspond to examples of the transfer units.

Meanwhile, a reference sensor (home position sensor) 42 that generates a reference signal as a reference for obtaining an image forming timing in each of the image forming units 1Y, 1M, 1C and 1K is disposed on an upstream side of the yellow image forming unit 1Y. An image density sensor 43 for adjusting image quality is disposed on a downstream side of the black image forming unit 1K. The reference sensor 42 recognizes a mark formed on the rear surface of the intermediate transfer belt 15 to generate the reference signal, and the image forming units 1Y, 1M, 1C and 1K start to form an image in response to an instruction from the control unit 40 based on the recognition of the reference signal.

As a transport unit that transports the sheet K, the image forming apparatus according to the present exemplary embodiment includes a sheet storage unit 50 that stores the sheets K, a sheet feed roll 51 that takes out the sheets K stored in the sheet storage unit 50 at a predetermined timing to transport the sheet, a transport roll 52 that transports the sheet K fed by the sheet feed roll 51, a transport guide 53 that sends the sheet K transported by the transport roll 52 to the secondary transfer unit 20, a transport belt 55 that transports the sheet K transported after the secondary transfer is performed by the secondary transfer roll 22 to the fixing device 60, and the fixing inlet guide 56 that guides the sheet K to the fixing device 60.

Next, a basic image forming process of the image forming apparatus according to the present exemplary embodiment will be described.

In the image forming apparatus according to the present exemplary embodiment, after image processing is performed on image data that is output from a non-illustrated image reading device, a non-illustrated personal computer (PC) or the like by a non-illustrated image processing unit, an image forming operation is performed by the image forming units 1Y, 1M, 1C and 1K.

In the image processing unit, various image processing operations such as shading correction, positional displacement correction, brightness/color space conversion, gamma correction, edge erasing or color editing, and various image editing operations such as motion editing are performed on input reflectivity data. The image data on which the image processing is performed is converted into color gradation data items of four colors of Y, M, C and K, and the converted data items are output to the laser exposure device 13.

The laser exposure device 13 irradiates the photoreceptors 11 of the image forming units 1Y, 1M, 1C and 1K with exposure beams Bm emitted from, for example, a semiconductor laser depending on the input color gradation data items. The surfaces of the photoreceptor 11 of the image forming units 1Y, 1M, 1C and 1K are charged by the charging device 12, and are scanned and exposed by the laser exposure device 13. Thus, electrostatic latent images are formed. The formed electrostatic latent images are developed as toner images of Y, M, C and K colors by the image forming units 1Y, 1M, 1C and 1K.

The toner images formed on the photoreceptors 11 of the image forming units 1Y, 1M, 1C and 1K are transferred onto the intermediate transfer belt 15 in the primary transfer unit 10 where the photoreceptors 11 and the intermediate transfer belt 15 come in contact with each other. More specifically, a voltage (primary transfer bias) having an opposite polarity to a charge polarity (minus polarity) of the toner is applied to the base material of the intermediate transfer belt 15 by the primary transfer roll 16 in the primary transfer unit 10, and the toner images are primarily transferred by being sequentially superposed onto the surface of the intermediate transfer belt 15.

After the toner images are primarily transferred onto the surface of the intermediate transfer belt 15 in sequence, the intermediate transfer belt 15 is moved, and the toner images are transported to the secondary transfer unit 20. When the toner images are transported to the secondary transfer unit 20, the sheet feed roll 51 is rotated at a timing corresponding to a timing in which the toner images are transported to the secondary transfer unit 20 in the transport unit, and the sheet K having a target size is fed from the sheet storage unit 50. The sheet K fed by the sheet feed roll 51 is transported by the transport roll 52, and reaches the secondary transfer unit 20 via the transport guide 53. Before the sheet reaches the secondary transfer unit 20, the sheet K is temporarily stopped, and a positioning roll (not shown) is rotated at a timing corresponding to a moving timing of the intermediate transfer belt 15 that holds the toner images to align a position of the sheet K and a position of the toner images.

In the secondary transfer unit 20, the secondary transfer roll 22 is pressurized by the rear roll 25 through the intermediate transfer belt 15. In this case, the sheet K transported at the corresponding timing is nipped between the intermediate transfer belt 15 and the secondary transfer roll 22. In this case, when a voltage (secondary transfer bias) having the same polarity as a charge polarity (minus polarity) of the toner is applied from the power supply roll 26, a transfer electric field is formed between the secondary transfer roll 22 and the rear roll 25. Unfixed toner images held on the intermediate transfer belt 15 are electrostatically transferred onto the sheet K at one time in the secondary transfer unit 20 pressurized by the secondary transfer roll 22 and the rear roll 25.

Thereafter, the sheet K onto which the toner images have been electrostatically transferred is transported while being peeled off from the intermediate transfer belt 15 by the secondary transfer roll 22, and is transported to the transport belt 55 provided on a downstream side of the secondary transfer roll 22 in a sheet transport direction. The transport belt 55 transports the sheet K up to the fixing device 60 at an optimum transport speed in the fixing device 60. The unfixed toner images on the sheet K transported to the fixing device 60 are fixed on the sheet K by performing a fixing process on the unfixed toner using heat and pressure by the fixing device 60. The sheet K on which the fixed images have been formed is transported to a sheet-ejection storage unit (not shown) provided at an exit unit of the image forming apparatus.

Meanwhile, after the transfer onto the sheet K is finished, residual toner remaining on the intermediate transfer belt 15 is transported up to the cleaning unit by the rotation of the intermediate transfer belt 15, and is removed from the intermediate transfer belt 15 by the cleaning rear roll 34 and the intermediate-transfer-belt cleaner 35.

Although the exemplary embodiments of the present invention have been described, the present invention is not to be restrictively interpreted by the aforementioned exemplary embodiments. It will be apparent that various modifications, changes and variations may be applied to the exemplary embodiments and may be implemented within the scope which meets the requirements of the present invention.

EXAMPLES

Hereinafter, the present exemplary embodiment will be described in detail in conjunction with examples, but the present exemplary embodiment is not limited to these examples. In the following description, all "parts" and "%" are based on weight unless otherwise specifically noted.

Manufacture of Fixing Belt

Example 1

For the innermost layer including the heat-resistant fibers, polyimide fibers (product name: P84, manufactured by TOYOBO CO., LTD., diameter of 10 μm, length of 3 mm) are added to polyimide varnish (product name: KX-R, manufactured by UNITIKA LTD.) to obtain 50% by weight of solids, and are mixed and stirred with a planetary mixer. The polyimide varnish to which the polyimide fibers are added is coated on a ϕ168 (outer diameter of 168 mm) aluminum mold by a blade coating method such that a thickness of the solid is 5 μm.

Subsequently, as the base material, polyimide varnish (product name: KX-R, manufactured by UNITIKA LTD.) is coated on the coated film as the innermost layer obtained through coating by a blade coating method such that a thickness of a solid is 70 μm. Thereafter, the innermost layer and the base material are dried for 20 minutes at 130° C., and are sintered for 20 minutes at a maximum temperature of 320° C. Subsequently, the innermost layer and the base material are cooled, and are released from the mold. As a result, the innermost layer including the polyimide fibers and the polyimide resin base material are obtained.

An addition curing type liquid silicone rubber is coated on the polyimide resin base material by a blade coating method to have a thickness of 300 μm, and the polyimide resin base material is primarily sintered for 20 minutes at 120° C. to coat a PFA tube on which an inner-surface adhesion process is performed. Thereafter, the PFA tube is secondarily sintered for 4 hours at 200° C. to obtain a fixing belt of Example 1.

Examples 2 to 11

Fixing belts of Examples 2 to 11 are obtained in the same manner as that in Example 1 except that a diameter, length and material of the heat-resistant fibers and a thickness of the innermost layer are changed as represented in Table 1 below.

In Table 1, "PI" represents polyimide fibers, and "PPS" represents polyphenylene sulfide fibers (product name: PROCON, manufactured by TOYOBO CO., LTD.).

Comparative Example 1

Polyimide varnish (product name: KX-R, manufactured by UNITIKA LTD.) is coated on a ϕ168 (outer diameter of 168 mm) aluminum mold whose surface is roughened through blast processing by a blade coating method such that a thickness of a solid is 80 μm. The solid is dried for 20 minutes at 130° C., and is sintered for 20 minutes at a maximum temperature of 320° C. Subsequently, the solid is cooled, and is released from the mold. As a result, a roughened polyimide resin base material (1) is obtained. A fixing belt of Comparative Example 1 is obtained in the same manner as that in Example 1 except that the polyimide resin base material (1) whose surface is roughened is used as the base material and the innermost layer including the heat-resistant fibers is not formed.

Comparative Example 2

Polyimide varnish (product name: KX-R, manufactured by UNITIKA LTD.) is coated on a ϕ168 (outer diameter of 168 mm) aluminum mold whose surface is roughened through cutting processing by a blade coating method such that a thickness of a solid is 80 μm. The solid is dried for 20 minutes at 130° C., and is sintered for 20 minutes at a maximum temperature of 320° C. Subsequently, the solid is cooled, and is released from the mold. As a result, a roughened polyimide resin base material (2) is obtained. A fixing belt of Comparative Example 2 is obtained in the same manner as that in Example 1 except that the polyimide resin base material (2) whose surface is roughened is used as the base material and the innermost layer including the heat-resistant fibers is not formed.

Evaluation

As the heating belt, the fixing belts obtained in the respective examples are attached to a fixing device of an image forming apparatus (Color Press 1000) manufactured by Fuji Xerox Co., Ltd. A travel test is performed by outputting one million images using J paper (manufactured by Fuji Xerox Co., Ltd.) by the image forming apparatus. After the travel test is finished, a retaining state of a lubricant on an inner circumferential surface of the fixing belt is observed.

As a fixing temperature, a temperature of the inner circumferential surface of the fixing belt is measured, and is controlled to be in a range of from 210° C. to 215° C.

Evaluation Criteria

A: A travel control error of the fixing belt does not occur until one million images are output. A retained amount of the lubricant of the inner circumferential surface of the fixing belt is maintained after the travel test is finished.

B: A travel control error of the fixing belt does not occur until one million images are output. A retained amount of the lubricant of the inner circumferential surface of the fixing belt is decreased after the travel test is finished.

C: A travel control error of the fixing belt occurs before one million images are output. A retained amount of the lubricant of the inner circumferential surface of the fixing belt does not remain after the travel test is finished.

TABLE 1

| | Innermost Layer | | | | | | | | |
|---|---|---|---|---|---|---|---|---|---|
| | | | | Heat-Resistant Fiber | | | | Surface | |
| | Innermost Layer Configuration | | Thickness μm | Diameter μm | Length mm | Material | Content % by weight | Roughness Ra | Evaluation |
| Example 1 | Present | Including Heat-Resistant Fibers | 5 | 10 | 3 | PI | 50 | 0.3 | A |
| Example 2 | Present | Including Heat-Resistant Fibers | 5 | 5 | 10 | PI | 50 | 0.1 | A |
| Example 3 | Present | Including Heat-Resistant Fibers | 5 | 12 | 2 | PI | 50 | 0.5 | B |
| Example 4 | Present | Including Heat-Resistant Fibers | 10 | 10 | 3 | PI | 50 | 0.1 | A |
| Example 5 | Present | Including Heat-Resistant Fibers | 4 | 10 | 3 | PI | 50 | 0.5 | B |
| Example 6 | Present | Including Heat-Resistant Fibers | 5 | 10 | 3 | PPS | 50 | 0.3 | B |
| Example 7 | Present | Including Heat-Resistant Fibers | 10 | 5 | 3 | PI | 50 | 0.1 | B |
| Example 8 | Present | Including Heat-Resistant Fibers | 5 | 10 | 3 | PI | 30 | 0.1 | A |
| Example 9 | Present | Including Heat-Resistant Fibers | 5 | 10 | 3 | PI | 70 | 0.5 | A |
| Example 10 | Present | Including Heat-Resistant Fibers | 5 | 10 | 3 | PI | 20 | 0.05 | B |
| Example 11 | Present | Including Heat-Resistant Fibers | 5 | 10 | 3 | PI | 80 | 0.6 | B |
| Comparative Example 1 | Absent | Roughened Base Material (1) | No | No | No | No | No | 0.3 | C |
| Comparative Example 2 | Absent | Roughened Base Material (2) | No | No | No | No | No | 0.3 | C |

As may be seen from the results, compared to the comparative examples, when the fixing belts of the present examples are used under a high-temperature condition, the reduction in the retained amount of the lubricant retained in the inner circumferential surface of the fixing member is suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing member comprising:

an annular base material; and an innermost layer that is formed on an inner circumferential surface of the annular base material, the innermost layer including heat-resistant fibers, wherein a diameter of the heat-resistant fibers is equal to or greater than a thickness of the innermost layer.

2. The fixing member according to claim 1, wherein an arithmetic average roughness (Ra) of the inner circumferential surface of the innermost layer is from 0.1 μm to 0.5 μm.

3. The fixing member according to claim 1, wherein a diameter of the heat-resistant fibers is from 1 μm to 10 μm, and a length of the heat-resistant fibers is from 3 mm to 30 mm.

4. The fixing member according to claim 2, wherein a diameter of the heat-resistant fibers is from 1 μm to 10 μm, and a length of the heat-resistant fibers is from 3 mm to 30 mm.

5. The fixing member according to claim 1, wherein a thickness of the innermost layer is from 5 μm to 20 μm.

6. The fixing member according to claim 2, wherein a thickness of the innermost layer is from 5 μm to 20 μm.

7. The fixing member according to claim 3, wherein a thickness of the innermost layer is from 5 μm to 20 μm.

8. The fixing member according to claim 4, wherein a thickness of the innermost layer is from 5 μm to 20 μm.

9. The fixing member according to claim 1, wherein the heat-resistant fibers are polyimide fibers.

10. A fixing device comprising:

a first rotating member; and a second rotating member that is disposed to come in contact with an outer surface of the first rotating member, wherein at least one of the first rotating member and the second rotating member is the fixing member according to claim 1.

11. An image forming apparatus comprising:

an image holding member;

a charging unit that charges a surface of the image holding member;

a latent image forming unit that forms a latent image on the charged surface of the image holding member;

a developing unit that develops the latent image by toner to form a toner image;

a transfer unit that transfers the toner image onto a recording medium; and a fixing unit that fixes the toner image on the recording medium, the fixing unit being the fixing device according to claim 10.

* * * * *